US007524050B2

(12) United States Patent
Baker et al.

(10) Patent No.: US 7,524,050 B2
(45) Date of Patent: Apr. 28, 2009

(54) INK JET PRINTING

(75) Inventors: Richard Baker, West Lebanon, NH (US); Melvin L. Biggs, Norwich, VT (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 395 days.

(21) Appl. No.: 11/402,457

(22) Filed: Apr. 11, 2006

(65) Prior Publication Data

US 2007/0236535 A1 Oct. 11, 2007

(51) Int. Cl.
*B41J 2/01* (2006.01)
*B41J 2/165* (2006.01)

(52) U.S. Cl. ..... 347/104; 347/33; 347/35; 347/36

(58) Field of Classification Search ..... 347/29–36, 347/102, 104
See application file for complete search history.

(56) References Cited

U.S. PATENT DOCUMENTS

| | | | | |
|---|---|---|---|---|
| 5,225,852 | A * | 7/1993 | Uchida et al. | 346/134 |
| 5,717,446 | A * | 2/1998 | Teumer et al. | 347/35 |
| 6,281,909 | B1 | 8/2001 | Fassler et al. | |
| 6,631,976 | B2 | 10/2003 | Hamamoto et al. | |
| 2004/0095404 | A1 | 5/2004 | Iwao et al. | |
| 2005/0200650 | A1 | 9/2005 | Inokuchi et al. | |
| 2005/0285894 | A1 | 12/2005 | Nakayama | |

* cited by examiner

*Primary Examiner*—Shih-Wen Hsieh
(74) *Attorney, Agent, or Firm*—Fish & Richardson P.C.

(57) ABSTRACT

An ink jet printing system including an ink jet print head configured to eject ink drops, a perforated substrate support having a plurality of holes, configured to carry a substrate over a first surface of the perforated substrate support, wherein the ink jet print head and the holes in the perforated substrate support are configured to allow at least a portion of ejected ink drops not received by the substrate to pass through the holes, and a collector disposed beneath the perforated substrate support, configured to collect at least a portion of the ejected ink drops not received by the substrate.

26 Claims, 3 Drawing Sheets

INK JET PRINTING

TECHNICAL FIELD

This application relates to the field of ink jet printing.

BACKGROUND

Ink jet printing is a non-impact method that produces droplets of ink that are deposited on a substrate such as paper or transparent film in response to an electronic digital signal. In various commercial or consumer applications, there is a general need to provide ink jet images that are printed edge-to-edge on a substrate. There is also a need for printing images on irregular and/or small substrates such as candy and cookies.

Ink jet printing systems generally are of two types: continuous stream and drop-on-demand. In continuous stream ink jet systems, ink is emitted in a continuous stream under pressure through at least one orifice or nozzle. Multiple orifices or nozzles also may be used to increase imaging speed and throughput. The ink is ejected out of orifices and perturbed, causing it to break up into droplets at a fixed distance from the orifice. At the break-up point, the electrically charged ink droplets are passed through an applied electric field that is controlled and switched on and off in accordance with digital data signals. Charged ink droplets are passed through a controllable electric field, which adjusts the trajectory of each droplet in order to direct it to either a gutter for ink deletion and recirculation or a specific location on a recording medium to create images. The image creation is controlled by electronic signals.

In drop-on-demand systems, a droplet is ejected from an orifice directly to a position on a recording medium by pressure created by, for example, a piezoelectric device, an acoustic device, or a thermal device controlled in accordance with digital data signals. An ink droplet is not generated and ejected through the nozzles of an imaging device unless it is to be placed on the recording medium.

SUMMARY

In one aspect, an ink jet printing system has an ink jet print head configured to eject ink drops, and a perforated substrate support comprising a plurality of holes and configured to carry a substrate over a first surface of the perforated substrate support, and a collector disposed beneath the perforated substrate support. The ink jet print head and the holes in the perforated substrate support are configured to allow at least a portion of ejected ink drops not received by the substrate to pass through the holes, and the collector is configured to collect at least a portion of the ejected ink drops not received by the substrate.

In another aspect, an ink jet printing system includes an ink jet print head configured to eject ink drops, a perforated substrate support comprising a plurality of holes and configured to carry a substrate over a first surface of the perforated substrate support, a conveying mechanism configured to cause relative movement between the ink jet print head and the perforated substrate support, a collector disposed behind the second surface of the perforated substrate support, and a cleaning station configured to clean the ink fluid captured on perforated substrate support. The ink jet print head and the holes in the perforated substrate support are configured to allow at least a portion of ejected ink drops to pass through the holes, and the collector is configured to collect at least a portion of the ejected ink drops not received by the substrate.

In yet another aspect, a method for printing an image on a substrate includes placing a substrate over a first surface of a perforated substrate support comprising a plurality of holes, causing relative movement between the substrate and an ink jet print head, disposing ink drops from the ink jet print head on the substrate to form an image, and collecting ink drops disposed outside of the edge of the substrate behind a second surface of the perforated substrate support.

Implementations of the system may include one or more of the following. The ink jet printing system can further include a conveying mechanism configured to cause relative movement between the ink jet print head and the perforated substrate support. The ink jet printing system can further include an ink absorbing material over the collector adapted to collect ink drops ejected by the ink jet print head. The ink jet printing system can further include a cleaning station configured to remove ink from the perforated substrate support. The ink jet printing system can further include a substrate handling mechanism configured to feed the substrate to the conveying mechanism or to retrieve the substrate from the conveying mechanism. The second surface of the perforated substrate support can be opposite to the first surface of the perforated substrate support. The perforated substrate support can include a cylindrical surface adapted to receive the substrate. The perforated substrate support can include a conveyance belt driven by one or more rollers. The ink jet printing system can further include a print head transport mechanism capable of moving the ink jet print head relative to the substrate. The ink jet printing system can further include one or more sensors configured to detect the location or the orientation of the substrate. The ink jet print head can deliver ink drops to form an image on the substrate. The ink jet print head can print the image full bleed along at least one edge of the substrate.

Embodiments may include one or more of the following advantages. The disclosed ink jet system is capable of full bleed printing while preventing the contamination of the substrate by the overspray inks. The system provides effective arrangements for collecting and cleaning the overspray inks. Furthermore, the disclosed ink jet system is capable of printing images on small and irregular shaped ink substrates without the need of pre-aligning the substrates before printing.

Implementations of the method for printing an image can include printing an image that is full bleed along at least one edge of the substrate.

The details of one or more embodiments are set forth in the accompanying drawing and in the description below. Other features, objects, and advantages of the invention will become apparent from the description and drawings, and from the claims.

DETAILED DESCRIPTION

Figure 1:
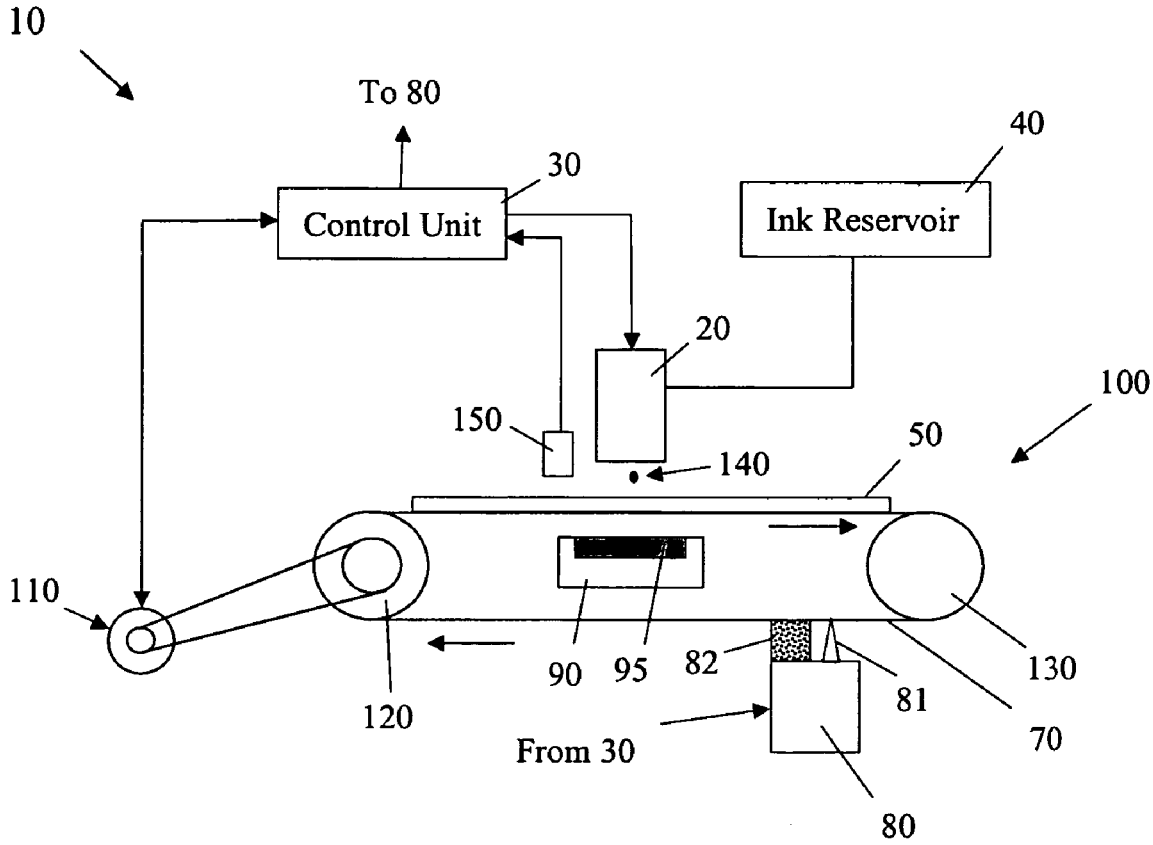
FIG. 1 illustrates an ink jet printing system having an ink jet print head and a substrate transport system comprising a perforated substrate support.

FIG. 1 shows an ink jet printing system 10 including an ink jet print head 20, a controller unit 30 that provides image data and other digital data to the ink jet print head 20, and an ink reservoir 40 for supplying ink to the ink jet print head 20. A substrate 50 is transported by a substrate transport system 100. The substrate transport system 100 includes a conveyor belt 70, rollers 120 and 130 for driving the conveyor belt 70, and a motor 110 that can drive the roller 120 under the control of the control unit 30.

One or more sensors 150 can detect the position and orientation of the substrate 50. The detection of the positions of the substrate 50 can be triggered by the edges of the substrate 50. The detection of the position of the substrate can facilitate the printing of the ink pattern on the substrate 50 from the leading edge and around the edges of the substrate 50. In another embodiment, the sensors 150 can detect both the position and the orientation of the substrate 50 on the perforated substrate support of the conveyor belt 70. In response to the signal received from the sensors 150, the control unit 30 can rotate the input digital image to compensate for the orientation variation of the substrate 50. As a result, an image can be printed with desired orientation over the substrate 50.

At least a portion of the conveyor belt 70 includes a perforated substrate support that includes holes that extend through the belt. The perforated substrate support can include a mesh of metal wires or a plastic sheet punched with holes. Preferably, the holes take a majority of the surface area of the conveyor belt 70 to allow overspray inks to pass through. The openings in the mesh or the punched holes can have dimensions in the range of 0.1 inch to one inch to allow ink drops to pass through while also keeping the substrate 50 flat. The top surface of the perforated substrate support preferably comprises an ink repelling material such as Teflon that helps to prevents ink accumulation in the solid portion of the perforated substrate support. The substrate 50 is carried by the perforated substrate support of the conveyor belt 70 to positions under the ink jet print head 20 to receive ink drops 140 ejected by the ink jet print head 20. As shown in FIG. 1, the substrate 50 can be carried by a flat portion of the conveyor belt 70 when the image is printed on the substrate 50 by the ink jet print head 20. Alternatively, the perforated substrate support carrying the substrate may be fixed during printing. The image is printed by scanning the ink jet print head over the substrate.

Figure 3:
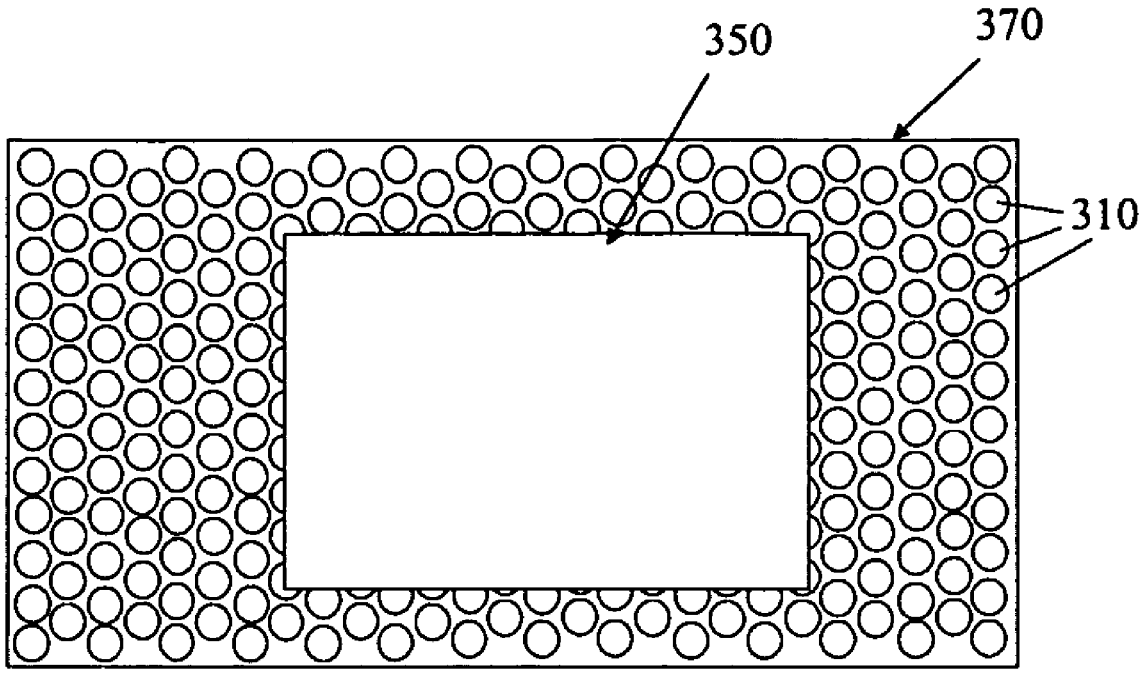
FIG. 3 is a top view of a substrate over a perforated substrate support in the substrate transport system of FIG. 1 and FIG. 2.

An example of the perforated substrate support 370 is shown in a top view in FIG. 3. The perforated substrate support 370 includes a plurality of holes 310 that occupy a large portion of the area. A substrate 350 is placed over a perforated substrate support 370 spanning over a plurality of holes 310.

The disclosed ink jet printing system 10 is capable of producing an image that is full bleed along at least one edge of the substrate 50. One known problem with full bleed printing is that the inks ejected from the print heads often sprays outside of the substrate along the edges of substrate where the image is printed full bleed to that edge. The overspray inks can contaminate the supporting substrate and the back surface of the substrate if not handled properly.

In one embodiment, the ink jet printing system 10 includes a collector 90 under the perforated substrate support in the conveyor belt 70. The overspray ink fluids outside of the edges of the substrate 50 can fall through the through holes of the perforated substrate support and be captured by the collector 90. The collector 90 can further include absorbent material 95. The absorbent material 95 can be replaceable or disposable to keep substrate transport mechanism 100 clean. The absorbent material 95 can include man made or natural materials. The absorbent material 95 can also be selected to be most effective in absorbing the specific types of inks used for each batch of substrates: for example, aqueous, solvent types of inks.

In another embodiment, the ink jet printing system 10 includes a cleaning station 80 that is capable of cleaning the conveyor belt 70 after the printing and after the substrate 50 is received. The cleaning station 80 can include a rubber blade 81 that can blade off the ink accumulated on the conveyor belt 70 and a sponge 82 that can wipe and absorb inks on the conveyor belt 70. The conveyor belt 70 can be cleaned regularly by wiping, blotting, washing, etc. after printing one or more a batch of substrates 50.

The ink jet printing system is particularly useful for printing small and/or irregular shaped substrates such as cookies and candy. The term irregular shape refers to a substrate that has at least one edge that is not straight. The positions and the orientations of the small and/or irregular shaped substrates can be detected by one or more sensors 150. The ink pattern printed can be full bleed along at least one edge of the substrate 50. The overspray inks can be captured by the collector 90 without contaminating the undersides of the substrates. The ink pattern can also be automatically adjusted according to the specific orientation of the substrate 50. The ink jet printing system therefore enables the ink jet printing on irregular shaped substrates without the need for aligning the substrates 50 on the conveyor belt 70.

Figure 2:
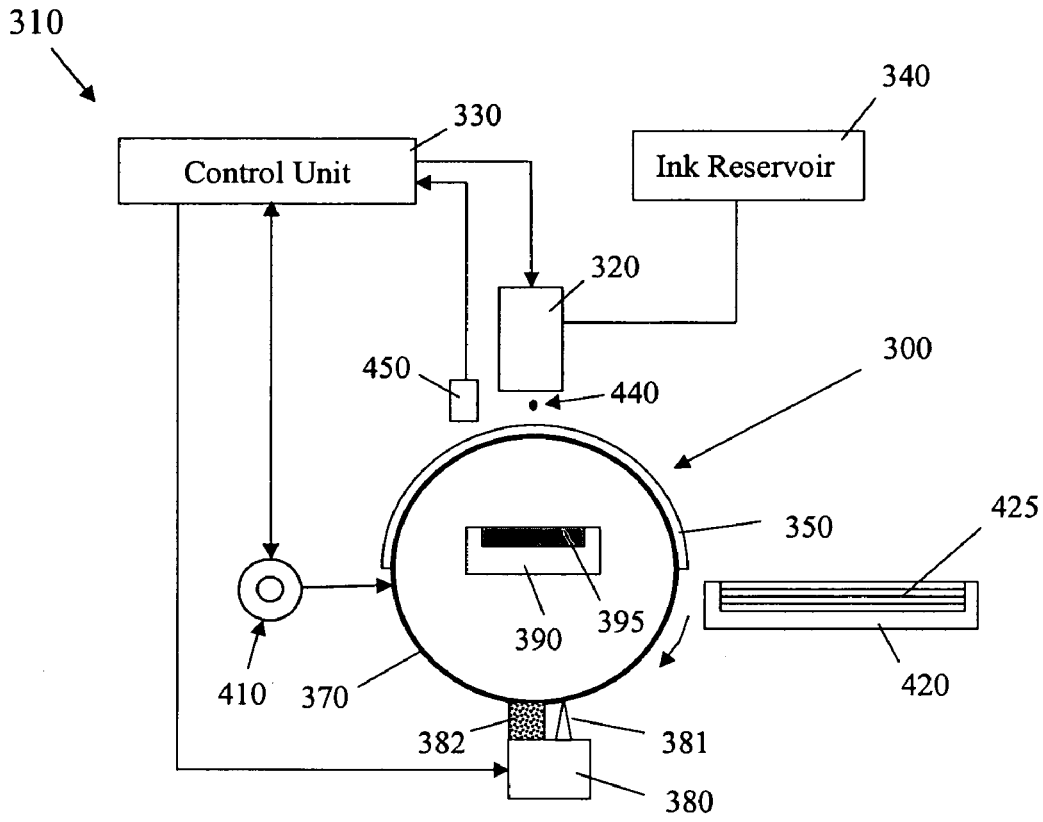
FIG. 2 illustrates an ink jet printing system having an ink jet print head and a substrate transport system comprising a perforated substrate support having a cylindrical surface.

In another embodiment as shown in FIG. 2, the ink jet printing system 310 includes an ink jet print head 320, a controller unit 330 that provides image data and other digital data to the ink jet print head 320, and ink reservoir 340 for supplying ink to the ink jet print head 320. A substrate 350 is transported by a substrate transport system 300 that includes a drum platen 370 and a motor 410 that can drive the drum platen 370 under the control of the control unit 330.

One or more sensors 450 can detect position and orientation of the substrate 350. The detection of the positions of the substrate 350 can be triggered by the edges of the substrate 350. The detection of the position of the substrate can facilitate the printing of the ink pattern on the substrate 350 from the leading edge and around the edges of the substrate 350. In another embodiment, the sensors 450 can detect both the position and the orientation of the substrate 530 on the perforated substrate support of the drum platen 370. In response to the signal received from the sensors 450, the control unit 330 can rotate the input digital image to compensate for the orientation variation of the substrate 350. As a result, an image can be printed with desired orientation over the substrate 350.

The drum platen 370 is bounded by a cylindrical surface adapted to receive the substrate 350. At least a portion of the drum platen 370 includes a perforated substrate support that includes through holes. The substrate 350 is attached to the perforated substrate support of the drum platen 370 by clamping or vacuum sucking. The substrate 350 is transported to positions under the ink jet print head 320 to receive ink drops 440 ejected by the ink jet print head 320. The overspray inks passing the through holes of the perforated substrate support are captured by a collector 390 that is fixed under the printing area inside the drum platen 370. The collector 390 may include ink absorbing materials 395. The surface of the drum platen can be cleaned regularly by a blade 381 and a sponge 382 when the contaminated area of the surface of the drum platen 370 is rotated to a cleaning station 380.

The substrate transport system 300 can further comprise a substrate picking mechanism for feeding the substrate 350 onto the drum platen 370, and a substrate retrieval mechanism for retrieving the substrate 350 from the drum platen 370. The released substrates 425 containing images can be held in a substrate tray 420.

Substrates compatible with the present invention include natural paper or man-made materials for displaying images including opaque, translucent, or transparent materials. The substrates can also include foods such as cookies, candies, and cakes. The substrates can also comprise plastics, ceramics, stone, metallic substrate, wood, and fabrics. Ink types compatible with the ink jet printing system described include water-based inks, solvent-based inks, and hot melt inks. The colorants in the inks can comprise dye or pigment. Furthermore, the ink jet printing system disclosed is also compatible with delivering other fluids such as polymer solutions, gel solutions, solutions containing particles or low molecular-weight molecules, which may or may not include any colorant.

A number of embodiments of the invention have been described. Nevertheless, it will be understood that various modifications may be made without departing from the spirit and scope of the invention. Accordingly, other embodiments are within the scope of the following claims.

What is claimed is:

1. An ink jet printing system, comprising:

an ink jet print head configured to eject ink drops; and a perforated substrate support comprising a plurality of holes and a flat portion between the holes, wherein the plurality of holes occupy a larger portion of the perforated substrate support than the flat portion, configured to carry a substrate over a first surface of the perforated substrate support, wherein the ink jet print head and the holes in the perforated substrate support are configured to allow at least a portion of ejected ink drops not received by the substrate to pass through the holes; and a collector disposed beneath the perforated substrate support, configured to collect at least a portion of the ejected ink drops not received by the substrate.

2. The ink jet printing system of claim 1, further comprising a conveying mechanism configured to cause relative movement between the ink jet print head and the perforated substrate support.

3. The ink jet printing system of claim 1, further comprising an ink absorbing material over the collector adapted to collect ink drops ejected by the ink jet print head.

4. The system of claim 3 wherein the collector is configured to collect overspray ink drops outside of an edge of the substrate.

5. The ink jet printing system of claim 1, further comprising a cleaning station configured to remove ink from the perforated substrate support.

6. The system of claim 5 wherein the cleaning station comprises a blade.

7. The system of claim 6 wherein the blade is made of rubber.

8. The system of claim 5 wherein the cleaning station comprises a sponge.

9. The ink jet printing system of claim 1, further comprising a substrate handling mechanism configured to feed the substrate to the conveying mechanism or to retrieve the substrate from the conveying mechanism.

10. The ink jet printing system of claim 1, wherein the perforated substrate support includes a conveyance belt driven by one or more rollers.

11. The ink jet printing system of claim 1, further comprising a print head transport mechanism capable of moving the ink jet print head relative to the substrate.

12. The ink jet printing system of claim 1, further comprising one or more sensors configured to detect the location or the orientation of the substrate.

13. The ink jet printing system of claim 1, wherein the ink jet print head delivers ink drops to form an image on the substrate.

14. The ink jet printing system of claim 1, wherein the ink jet print head is configured to print the image full bleed along at least one edge of the substrate.

15. An ink jet printing system, comprising:

an ink jet print head configured to eject ink drops;

a perforated substrate support comprising a plurality of holes and a flat portion between the holes, wherein the plurality of holes occupy a larger portion of the perforated substrate support than the flat portion, configured to carry a substrate over a first surface of the perforated substrate support, wherein the ink jet print head and the holes in the perforated substrate support are configured to allow at least a portion of ejected ink drops to pass through the holes;

a conveying mechanism configured to cause relative movement between the ink jet print head and the perforated substrate support;

a collector disposed behind the second surface of the perforated substrate support, configured to collect at least a portion of the ejected ink drops not received by the substrate; and a cleaning station configured to clean the ink fluid captured on perforated substrate support.

16. The ink jet printing system of claim 15, further comprising a controller configured to control the ink jet print head to eject the ink drops and to control the conveying mechanism to cause relative movement between the ink jet print head and the perforated substrate support.

17. The ink jet printing system of claim 15, wherein the perforated substrate support includes a conveyance belt driven by one or more rollers.

18. The ink jet printing system of claim 15, further comprising a print head transport mechanism capable of moving the ink jet print head relative to the substrate.

19. The ink jet printing system of claim 15, wherein the ink jet print head delivers ink drops to form an image on the substrate wherein the image is full bleed along at least one edge of the substrate.

20. The system of claim 15 wherein the cleaning station comprises a blade.

21. The system of claim 20 wherein the blade is made of rubber.

22. The system of claim 15 wherein the cleaning station comprises a sponge.

23. A method for printing an image on a substrate, comprising:

placing a substrate over a first surface of a perforated substrate support comprising a plurality of holes and a flat portion between the holes, wherein the plurality of holes occupy a larger portion of the perforated substrate support than the flat portion;

causing relative movement between the substrate and an ink jet print head;

disposing ink drops from the ink jet print head on the substrate to form an image; and collecting ink drops disposed outside of an edge of the substrate behind a second surface of the perforated substrate support.

24. The method of claim 23 wherein the image is full bleed along at least one edge of the substrate.

25. The method of claim 23 further comprising blading off ink drops accumulated on the perforated substrate by a blade.

26. The method of claim 23 further comprising wiping and absorbing ink drops accumulated on the perforated substrate by a sponge.

* * * * *

UNITED STATES PATENT AND TRADEMARK OFFICE

CERTIFICATE OF CORRECTION

PATENT NO. : 7,524,050 B2
APPLICATION NO. : 11/402457
DATED : April 28, 2009
INVENTOR(S) : Richard Baker and Melvin Biggs It is certified that error appears in the above-identified patent and that said Letters Patent is hereby corrected as shown below:

Column 6, Below Claim 26; insert:

-- 27. The ink jet printing system of claim 1, wherein the perforated substrate support includes a cylindrical surface adapted to receive the substrate.

28. The ink jet printing system of claim 15, wherein the perforated substrate support includes a cylindrical surface adapted to receive the substrate. --

Signed and Sealed this

Twenty-third Day of June, 2009

John Doll

JOHN DOLL
*Acting Director of the United States Patent and Trademark Office*